United States Patent [19]

Nuver

[11] 4,134,043

[45] Jan. 9, 1979

[54] LIGHTING CIRCUITS

[75] Inventor: Eric L. H. Nuver, Monterrey, Mexico

[73] Assignee: Esquire, Inc., New York, N.Y.

[21] Appl. No.: 712,937

[22] Filed: Aug. 9, 1976

Related U.S. Application Data

[63] Continuation-in-part of Ser. No. 674,447, Apr. 7, 1976, abandoned.

[51] Int. Cl.[2] ..... H05B 41/231; H05B 41/46

[52] U.S. Cl. ..... 315/92; 315/136; 315/245; 315/276; 315/DIG. 5

[58] Field of Search ..... 315/88, 92, 105, 106, 315/136, 209 R, 225, 245, 246, 276, 282, DIG. 2, DIG. 5, DIG. 7

[56] References Cited

U.S. PATENT DOCUMENTS

| | | | |
|---|---|---|---|
| Re. 29,204 | 3/1977 | Snyder | 315/106 |
| 3,517,254 | 6/1970 | McNamara | 315/91 |
| 3,582,708 | 6/1971 | Snyder | 315/91 |
| 3,611,432 | 10/1971 | Babcock et al. | 315/92 |
| 3,659,146 | 4/1972 | Munson | 315/92 |

*Primary Examiner*—Eugene R. LaRoche
*Attorney, Agent, or Firm*—Arnold, White & Durkee

[57] ABSTRACT

Circuits are disclosed for use in a gaseous-discharge lamp lighting system which provide starting pulses to the lamp and/or a source of auxiliary light. One circuit provides starting pulses and/or auxiliary light until the gaseous-discharge lamp approaches its normal operating condition, while other circuits terminate these functions once the gaseous-discharge lamp ignites.

123 Claims, 13 Drawing Figures

501

VOLTAGE SOURCE
503
502a
502

500

610
602
602c
S
132
606
604
600
601
131
131
603
LAMP
602b
STOP
VOLTAGE TAP
COMMON
LINE
602a
101

LIGHTING CIRCUITS

CROSS-REFERENCE TO RELATED APPLICATIONS

This application is a continuation-in-part of U.S. Patent application Ser. No. 674,447, filed Apr. 7, 1976, now abandoned.

BACKGROUND OF THE INVENTION

1. Field of the Invention

This invention relates to circuits for use in lighting systems employing gaseous-discharge lamps.

2. Description of the Prior Art

Gaseous-discharge lamps have frequently been employed in industrial lighting situations, because of their high efficiency when compared with other light sources, such as incandescent lamps. A gaseous-discharge lamp is a source of radiant energy characterized by the emission of radiation from a stream of ionized current-carrying vapor between the electrodes of the lamp.

The types of gaseous-discharge lamps which are commonly in use today include the mercury vapor, the metal halide, and the high pressure sodium lamps. In operation, several characteristics of each type of lamp are similar. For example, a voltage higher than the normal operating voltage of the lamp is required to ignite the lamp. Once current flows in the lamp, it exhibits a negative resistance characteristic, i.e., the resistance of the lamp decreases with an increase in current through the lamp. Gaseous-discharge lamp lighting systems utilize a ballast to compensate for the negative resistance characteristic of the lamp, and the ballast is connected between the energizing source and the lamp to limit the current through the lamp during normal operation.

One type of ballast which has been used in gaseous-discharge lamp lighting systems is the lead-peaked, regulating ballast. This type of ballast is characterized in that: (1) It is a lead-type ballast; and (2) the ratio of the value of the peak open circuit voltage to the RMS value of the open circuit voltage is higher than for other types of ballasts. Each type of lighting circuit described in this specification may be used in a gaseous-discharge lamp lighting system employing this type of ballast.

While some operating characteristics of all types of gaseous-discharge lamps are similar, other characteristics are quite different. The technique which is required to start the lamp is one example of a characteristic which differs between lamp types. For example, when a gaseous-discharge lamp lighting system employing a mercury vapor lamp is initially energized, no current flows through the lamp and the open circuit voltage of the ballast appears across the lamp. This open circuit voltage is sufficient to enable the lamp to start by means of a starting electrode. Other types of lamps, e.g., the high pressure sodium lamp, do not readily permit the use of a starting electrode. Rather, a high voltage pulse or pulses must be applied to the lamp to start it. It is common for such a lamp to require 50 starting pulses per second, where each pulse has a peak voltage of 2,500 volts sustained for more than one microsecond.

Some time after the gaseous-discharge lamp ignites, it is desirable to terminate the generation of further starting pulses, and starting circuits typically employ some shut-off technique to accomplish this result. The generation of starting pulses may be discontinued immediately upon ignition of the lamp, or may continue until the lamp approaches its normal operating condition and then be discontinued.

Circuits which generate starting pulses for gaseous-discharge lamps have been available, e.g., as disclosed in U.S. Pat. No. 3,681,653 to Snyder. Starting circuits for lighting systems employing lead-peaked, regulating type ballasts have also been available, but these starting circuits typically employ relatively complex techniques to discontinue the generation of starting pulses.

Another characteristic of a gaseous-discharge lamp is that several minutes will pass between the time the lamp ignites and the time the lamp reaches its normal operating condition. The difference in these two times is commonly referred to as the warmup period for the lamp, the the warmup period for a given lamp can vary depending upon a number of factors. During the warmup period, the luminescence of the lamp is not as great as it is when the lamp reaches the normally operating condition. Consequently, auxiliary sources of light, e.g., an incandescent lamp, have been included in some gaseous-discharge lamp lighting systems to provide light during the warmup period. When the gaseous-discharge lamp approaches its normal operating condition, the auxiliary source of light is extinguished. Typically, the auxiliary source of light will not be activated again until the gaseous-discharge lamp fails or has to be reignited following a power interruption.

Auxiliary lighting systems have not generally been employed in gaseous-discharge lamp lighting systems in which the gaseous-discharge lamp requires starting pulses for ignition, because the high voltage level of the starting pulses is detrimental to certain components commonly used in such auxiliary lighting systems.

SUMMARY OF THE INVENTION

A first embodiment of the present invention is a starter circuit, which generates starting pulses for a gaseous-discharge lamp, and these starting pulses are generated while the gaseous-discharge lamp warms up. As the gaseous-discharge lamp approaches its normal operating condition, a sensing circuit, including a reactance, disables the pulse generation circuit, thereby preventing further generation of starting pulses.

The first embodiment of the present invention may additionally provide a source of auxiliary light during the warmup of the gaseous-discharge lamp. When the sensing circuit disables the pulse generation circuit, the auxiliary light is no longer energized.

Another embodiment of the present invention also generates starting pulses for a gaseous-discharge lamp, and this embodiment discontinues the generation of starting pulses once the lamp ignites. This embodiment may also provide auxiliary light until the gaseous-discharge lamp approaches its normal operating condition.

Yet another embodiment of the present invention is an auxiliary lighting circuit for a gaseous-discharge lamp lighting system. This embodiment may be used with a gaseous-discharge lamp which does or does not require starting pulses to ignite. This embodiment provides auxiliary light while the gaseous-discharge lamp warms up, and as the gaseous-discharge lamp approaches its normal operating condition, a sensing circuit prevents the auxiliary light source from being further energized.

Still another embodiment of the present invention provides a source of auxiliary light in a gaseous-discharge lamp lighting systems until the gaseous-discharge lamp ignites. When the gaseous-discharge lamp ignites, the source of auxiliary light is extinguished.

DESCRIPTION OF THE PREFERRED EMBODIMENTS

It will be appreciated that the present invention can take many forms and embodiments. Several embodiments of the invention will be described so as to give an understanding of the invention. It is not intended, however, that these illustrative embodiments should in any way limit the true scope and spirit of the invention.

It is preferrable to use each disclosed circuit of the present invention in a gaseous-discharge lamp lighting system which employs a lead-peaked regulating type ballast. Those skilled in the art will recognize, however, that the disclosed circuits may also be used in systems employing other types of ballasts. The term "ballast" is used to designate both the lead-peaked regulating and other types of ballasts in this specification.

The accompanying drawings and the following description illustrate detailed interconnection of components comprising embodiments of the present invention. Those skilled in the art will recognize that an embodiment may include other components which are connected between any two illustrated components, but which do not affect the overall operation of that embodiment. It will be understood, therefore, that the term "operatively connected" embraces: (1) A direct connection between two components; or (2) a connection of the two components through an additional component or components.

Figure 1:
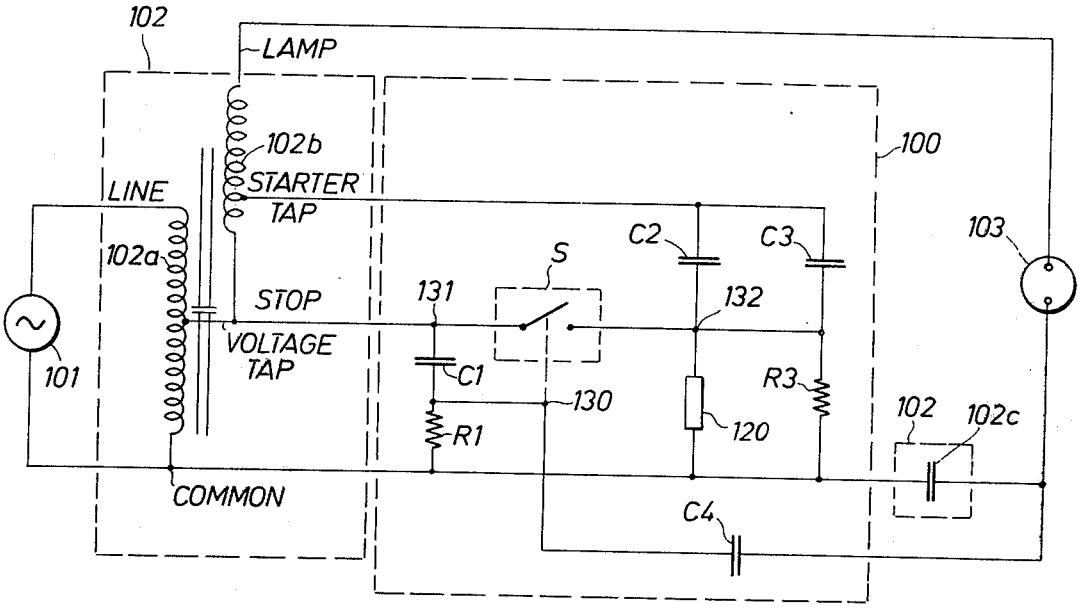
FIG. 1 is an electrical schematic diagram which illustrates an embodiment of a starter circuit according to the invention, in a gaseous-discharge lamp lighting system having a ballast in which the starter winding is part of the secondary of the ballast.

Referring to FIG. 1, the illustrated gaseous-discharge lamp lighting system first comprises ballast 102, which includes: a primary winding **102*a*, which has start and stop windings and a voltage tap; secondary 102*b* which has start and stop windings and a starter winding which is an integral part of secondary 102*b*; and ballast capacitor 102*c*. The start and stop windings of primary 102*a* are commonly referred to as the line and common leads of ballast 102, respectively, and this designation is utilized in the remainder of this specification. The start winding of secondary 102*b* is commonly referred to as the lamp lead of ballast 102, and this designation will also be utilized in the remainder of the specification. A starter tap is provided in secondary 102*b* for the application of starting pulses. Ballast capacitor 102*c*** is preferably an oil-filled capacitor.

A source of AC voltage 101 is applied across the line and common leads of ballast 102. In gaseous-discharge lamp lighting systems, the RMS value of the AC voltage source 101 often exceeds 120 volts. This being the case, the voltage tap of primary winding **102*a* may be located on primary 102*a*** such that 120 volts (RMS) appears there.

The voltage tap of primary **102*a* is connected to the stop (or end) winding of secondary 102*b*. The serial combination of gaseous-discharge lamp 103 and ballast capacitor 102*c* is connected in parallel between the lamp and common leads of ballast 102, with one terminal of gaseous-discharge lamp 103 being connected to the lamp lead of ballast 102**.

The illustrated embodiment of starter circuit 100 comprises timing capacitor C1, pulser capacitor C2, shutoff capacitor C4, timing resistor R1, resistive element 120, and switch S. One terminal of timing capacitor C1 is connected to the stop winding of secondary **102*b*, and the second terminal of timing capacitor C1 is connected to the first terminals of timing resistor R1 and shutoff capacitor C4. The second terminal of timing resistor R1 is connected to the common lead of ballast 102. Pulser capacitor C2 and resistive element 120 are connected in a serial arrangement between the starter tap of secondary 102*b* and the common of ballast 102, with one terminal of pulser capacitor C2 being connected to the starter tap. The main terminals of switch S are connected between the stop winding of secondary 102*b* and the point of connection between pulser capacitor C2 and resistive element 120**.

Figure 4A:
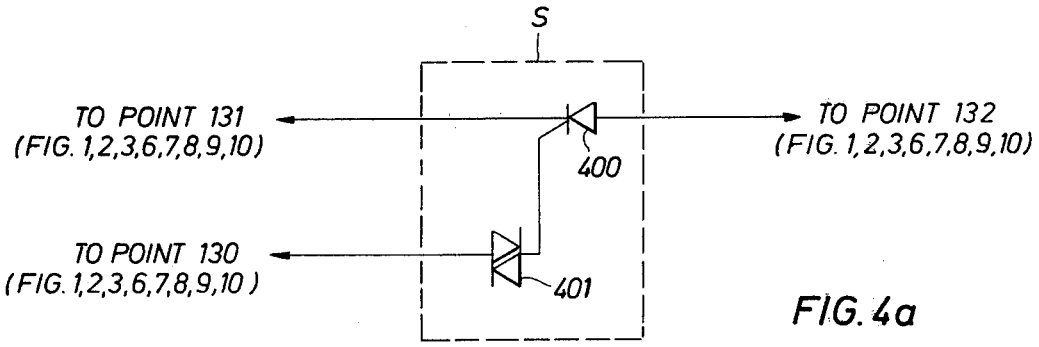
FIG. 4*a* is an electrical schematic diagram which illustrates one embodiment of the switch of FIGS. 1–3.
Figure 4B:
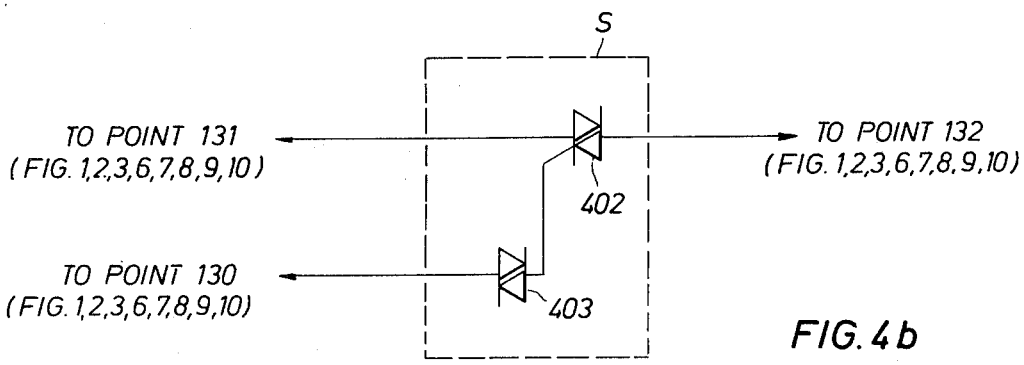
FIG. 4*b* is an electrical schematic diagram which illustrates a preferred embodiment of the switch of FIGS. 1–3.

Switch S is a voltage dependent switch and closes when the voltage across timing capacitor C1 reaches a certain level. As long as the voltage across timing capacitor C1 is below that level, switch S will remain open. Although switch S preferably includes solid state elements as shown in FIGS. 4*a* and 4*b*, it will be appreciated that other switching devices, such as relays, might also be employed.

The operation of the illustrated embodiment of starter circuit 100 is described by assuming that gaseous-discharge lamp 103 is extinguished. When AC voltage source 101 is energized, current flows from the voltage tap of primary 102*a* via the starter turns of secondary 102*b*. Since gaseous-discharge lamp 103 is extinguished, this current flows through the serial combination of pulser capacitor C2 and resistive element 120. This current charges pulser capacitor C2 at a rate dictated by the values of pulser capacitor C2 and resistive element 120 and by the applied voltage. At the same time, current also flows from the voltage tap of primary 102*a* into the serial combination of timing capacitor C1 and timing resistor R1. This current charges capacitor C1 at a rate dictated by the values of timing capacitor C1 and timing resistor R1 and by the voltage which is present at the voltage tap of primary 102*a*.

If it is assumed that the voltage across timing capacitor C1 is initially zero volts, the voltage across timing capacitor C1 will rise until a sufficient voltage level is achieved across it to close switch S. When switch S closes, pulser capacitor C2 rapidly discharges through the starter windings of secondary 102*b*. At this time a very high voltage will be developed between the lamp lead and the stop winding of the secondary due to the transformation action of secondary 102*b*. This voltage plus the voltage between the voltage tap of primary 102*a* and the common lead of ballast 102 is seen by gaseous-discharge lamp 103.

A plurality of starting pulses may have to be applied to gaseous-discharge lamp 103 before it fires and begins to conduct current. When gaseous-discharge lamp 102 does fire, the voltage across it will be low, and there will be a fairly high voltage across ballast capacitor 102*c* that is seen by shutoff capacitor C4. The network of timing capacitor C1, shutoff capacitor C4, and timing resistor R1 senses the changing amplitude and phase relationships between the voltage across ballast capacitor 102*c* and the voltage between the voltage tap and common as the lamp 103 warms up. During the initial warm-up period of lamp 103, the amplitude and phase angle of the voltage across ballast capacitor 102*c* with respect to the voltage at the voltage tap are such that the voltage appearing across timing capacitor C1 during each half cycle of the AC input voltage 101 is sufficient to close switch S. When, however, gaseous-discharge lamp 103 approaches its normal operating condition, the amplitude and phase angle of the charging current into timing capacitor C1 from timing resistor R1 and the amplitude and phase angle of the charging current into timing capacitor C1 from shutoff capacitor C4 are such that timing capacitor C1 ceases to charge to a sufficient level to close switch S. Hence, at this time the embodiment of starter circuit 100 ceases to generate additional high voltage pulses to gaseous-discharge lamp 103.

Now referring to FIG. 4*a*, there is illustrated one embodiment of switch S which may be utilized in the embodiment of starting circuit 100 illustrated in FIG. 1. As shown, it comprises silicon controlled rectifier (SCR) 400 and diac 401. The components comprising this embodiment of switch S are connected to the components illustrated in FIG. 1 as follows. The anode of SCR 400 is connected to the junction between pulser capacitor C2 and resistive element 120; the cathode of SCR 400 is connected to the common junction of the voltage tap of primary 102*a*, the stop winding of secondary 102*b* and the first terminal of capacitor C1; the gate of SCR 400 is connected to one terminal of capacitor C1; the gate of SCR 400 is connected to one terminal of diac 401; and the second terminal of diac 401 is connected to point 105.

Referring to both FIGS. 1 and 4*a*, suppose that the embodiment of switch S illustrated in FIG. 4*a* is utilized in the starting circuit illustrated in FIG. 1 and suppose that gaseous-discharge lamp 103 is extinguished. When AC voltage source 101 is energized, current flows from the voltage to tap via the starting windings of secondary 102*b*. Since gaseous-discharge lamp is extinguished, this current flows through the said combination of pulser capacitor C2 and resistive element 120. This current charges pulser capacitor C2 at a rate dictated by the values of pulser capacitor C2 and resistive element 120 and by the applied voltage. Current also flows via the voltage tap of primary 102*a* through the serial combination of timing capacitor C1 and timing resistor R1 to charge timing capacitor C1. The voltage appearing across the terminals of diac 401 is essentially the voltage across timing capacitor C1, and, when the voltage across timing capacitor C1 exceeds the forward breakover voltage of diac 401, diac 401 switches from a non-conductive state to a conductive state. At this time, a current is delivered from the charge on capacitor C1 into the gate of SCR 400. This gate current enables SCR 400 to switch from a non-conductive state to a conductive state, if the anode of SCR 400 is positive with respect to the cathode of SCR 400. When SCR 400 is in a conductive state, capacitor C2 rapidly discharges into the starter windings of secondary 102*b*. A high voltage will then be developed between the lamp lead and the stop winding of secondary 102*b* of ballast 102, and this voltage, plus the voltage between the voltage tap and the common lead of ballast 102, is applied to gaseous-discharge lamp 103. Since SCR 400 will only conduct current in one direction, a starting pulse will be applied to gaseous-discharge lamp 103 on alternate half-cycles of the input AC voltage.

Now referring to FIGS. 1 and 4*b*, in FIG. 4*b* there is illustrated a preferred embodiment of switch S, which comprises triac 402 and diac 403. When this embodiment of switch S is utilized, the components are connected as follows. One main terminal of triac 402 is connected to the common connection between pulser capacitor C2 and resistive element 120; the second main terminal of triac 402 is connected to the voltage tap of primary 102*a*; the gate terminal of triac 402 is connected to one terminal of diac 403; and the second terminal of diac 403 is connected to point 105. In this embodiment of switch S, diac 403 switches from a non-conducting state to a conducting state whenever the voltage across timing capacitor C1 exceeds the forward breakover voltage of diac 403. Since triac 402 is a bi-directional current-carrying device, a starting pulse is applied to gaseous-discharge lamp 103 during each half cycle of AC input voltage 103. When gaseous-discharge lamp 103 approaches its normal operating condition, the amplitude and phase angle of the charging current into timing capacitor C1 from timing resistor R1 and the amplitude and phase angle of the charging current into timing capacitor C1 from shutoff capacitor C4 are such that timing capacitor C1 ceases to charge above the forward breakover voltage of diac 403. When this occurs, no additional starting pulses are applied to gaseous-discharge lamp 103.

Figures 5A, 5B, 5C, 6:
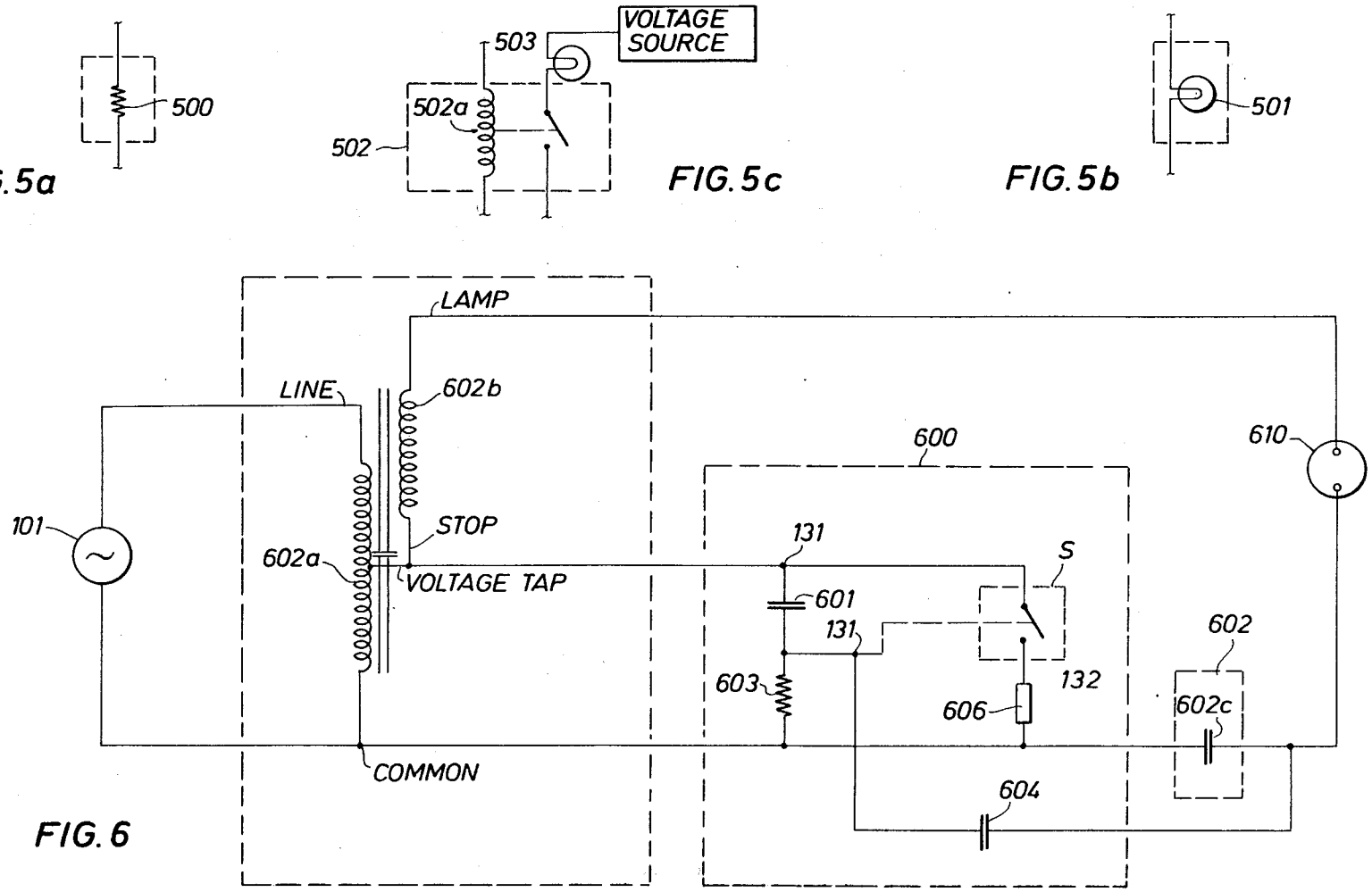
FIG. 5*a* is an electrical schematic diagram which illustrates a resistor.
FIG. 5*b* is an electrical schematic diagram of an incandescent lamp.
FIG. 5*c* is an electrical schematic diagram of a relay in combination with an incandescent light and a voltage source.
FIG. 6 is an electrical schematic diagram which illustrates an embodiment of an auxiliary lighting circuit according to the present invention.

Now referring to FIGS. 1, 5*a*, 5*b* and 5*c*, one embodiment of resistive element 120 includes power resistor 500 (FIG. 5*a*), another embodiment of resistive element 120 includes incandescent lamp 501 (FIG. 5*b*), and yet another embodiment of resistive element 120 includes the coil of relay 502 (FIG. 5*c*). When incandescent light 501 is utilized in the embodiment of starter circuit 100, current is provided to incandescent lamp 501 from the voltage tap of primary 102*a* whenever switch S is closed. As previously discussed, switch S opens and remains open when gaseous-discharge lamp 103 approaches its normal operating condition. When, therefore, the embodiment of starter circuit 100 comprises incandescent lamp 501, starter circuit 100 also functions to provide an auxiliary source of light until gaseous-discharge lamp 103 approaches its normal operating condition. Should lamp 103 ever cease to be functional, e.g., because lamp 103 fails or because of a momentary power interruption, incandescent lamp 501 will be powered and provide an auxiliary source of light. It is preferable that the FIG. 4*b* embodiment of switch S be utilized, if resistive element 120 comprises incandescent lamp 501 in order to permit conduction in both directions, and hence provide more lighting time per cycle of input voltage.

Referring to FIGS. 1 and 5*c*, starter circuit 100 may provide an auxiliary source of light when resistive element 120 comprises the coil 502*a* of relay 502. When switch S is closed, current flows from the voltage tap of ballast 102 through the serial combination of switch S and the coil 502*a* of relay 502. If switch S is chosen such that contacts 502*b* are engaged by this current, incandescent lamp 503 will be energized from voltage source 502 while switch S is closed. Those skilled in the art will realize that the voltage appearing at the voltage tap and the resistance of coil 502*a* are factors to be considered in choosing a relay for proper operation of the auxiliary lighting circuit.

Referring again to FIG. 1, if gaseous-discharge lamp 103 is located at some distance from ballast 102, the capacitance of the leads between gaseous-discharge lamp 103 and ballast 102 will attenuate the high voltage pulses delivered to the lamp during starting. In this case, an embodiment of starter circuit 100 may additionally comprise pulser capacitor C3 and resistor R3. The addition of pulser capacitor C3 and resistor R3 will help overcome the attenuation problem of the lamp leads when gaseous-discharge lamp 103 is located remote from ballast 102, by providing additional discharge current.

The time constant (T2) defined by the product of the values of pulser capacitor C2 and resistive element 120 is preferably less than the time constant (T1) defined by the product of the values of timing capacitor C1 and timing resistor R1. With time constant T2 greater than time constant T1, pulser capacitor C2 is almost fully charged when the voltage across timing capacitor C1 is sufficient to close switch S. Consequently, pulser capacitor C2 is able to deliver a maximum current to the starter windings of secondary 102*b* of ballast 102 when switch S closes.

Manufacturers of high pressure sodium gaseous-discharge lamps specify that the starting pulse for the lamp should be applied within a specified number of electrical degrees from the positive and negative peaks of the input AC voltage. In order to comply with this specification, a potentiometer may be included in series with timing resistor R1. As the resistance of the potentiometer is varied, time constant T1 will vary and the time at which the voltage across timing capacitor C1 is sufficient to close switch S varies.

Referring to FIGS. 1 and 4*b*, the values and types of components comprising one embodiment of starter circuit 100 which is designed to operate with a 240 volt, 60 Hz input voltage 101, are as follows.

Timing capacitor C1 should preferably have a positive temperature coefficient to compensate for the negative temperature coefficient of diac Y1. A capacitor having a polyester foil or mylar foil has such a positive temperature coefficient. Capacitor C1 perferably has a value of 0.1 microfarads, ±10 percent, (100 WVDC).

Timing resistor R1 may be a standard carbon resistor having no special characteristics. The nominal value of timing resistor R1 is 100,000 ohms, ½ watt, 5 percent.

Pulser capacitor C2 (and C3, when utilized) should have a construction that can handle high peak currents during the starting of the gaseous-discharge lamp. One suitable type of capacitor is one having a polypropylene or high quality mylar dielectric. The preferred value of pulser capacitor C2 (and C3, when utilized) is one microfarad, ±10 percent, rated for 200 V AC RMS.

When resistive element 120 comprises resistor 500 (FIG. 5*a*), resistor 500 is preferably a power resistor having a value of 1000 ohms, a wattage rating of 10–12 watts, and a tolerance factor of ±10 percent. Resistor R3, when utilized, preferably has the same vale set forth in the preceeding sentence.

Shut-off capacitor C4 should be a low leakage capacitor with a high voltage rating and should preferably be AC rated for at least 600 volts RMS. The preferred value of capacitor C4 is 5.6 nanofarads, ±10 percent.

Diac 403 is preferably a 1N5761A, and triac 402 is preferably a 2N6157, each of which is manufactured by Motorola, Inc.

Figure 2:
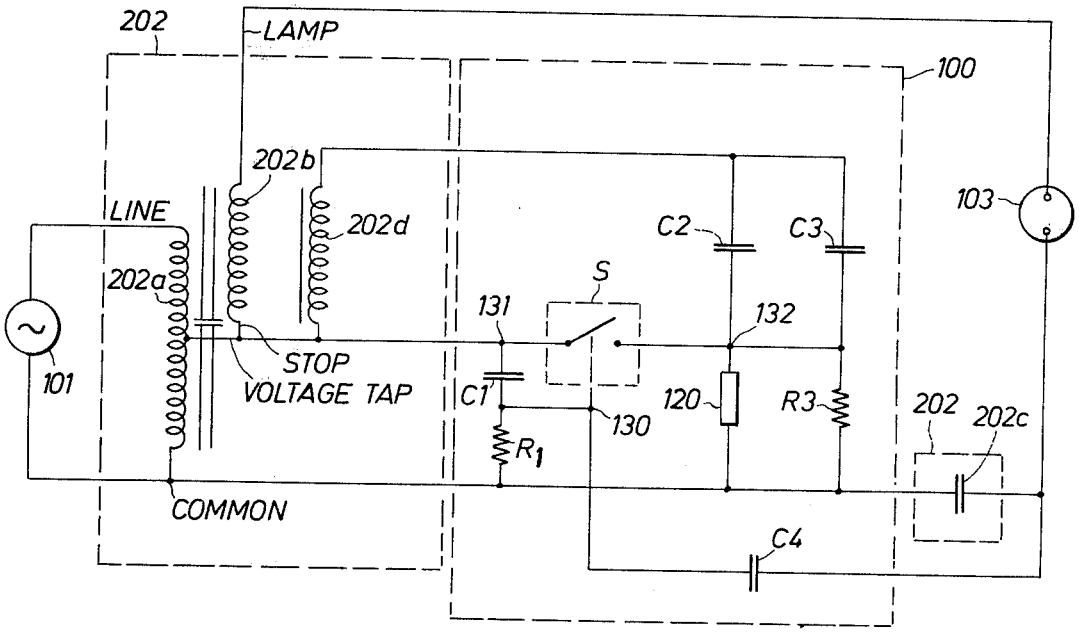
FIG. 2 is an electrical schematic diagram which illustrates the manner in which an embodiment of the starter circuit according to the invention may be utilized in a gaseous-discharge lamp lighting system having a ballast which has an insulated starter winding.

Referring now to FIG. 2, there is illustrated the manner in which an embodiment of starting circuit 100 is utilized with a ballast 202 which has an insulated starter winding 202*d*. With this type starter winding, pulser capacitor C2 charges when switch S is open. When the voltage across timing capacitor C1 is sufficient to close switch S, C2 discharges through starter winding 202*d*, and the magnetic coupling between starter winding 202*d* and secondary 202*b* induces a high voltage between the lamp lead and stop winding of secondary 202*b*. This high voltage plus the voltage between the voltage tap and the common lead of the ballast is applied to gaseous-discharge lamp 103. Shutoff capacitor C4 again functions to prevent the voltage across timing capacitor C1 from reaching a sufficient level to close switch S as gaseous-discharge lamp 103 approaches its normal operating condition. Either of the embodiments of switch S illustrated in FIGS. 4*a* and 4*b* may be utilized in the starter circuit 100, and resistive element 120 may comprise a resistor 500 (FIG. 5*a*) an incandescent lamp 501 (FIG. 5*b*), or a coil 502*a* of a relay (FIG. 5*c*). When resistive element 120 comprises incandescent lamp 501, it is preferable that the FIG. 4*b* embodiment of switch S be utilized in starting circuit 100 to provide more lighting time per cycle of input voltage.

Figure 3:
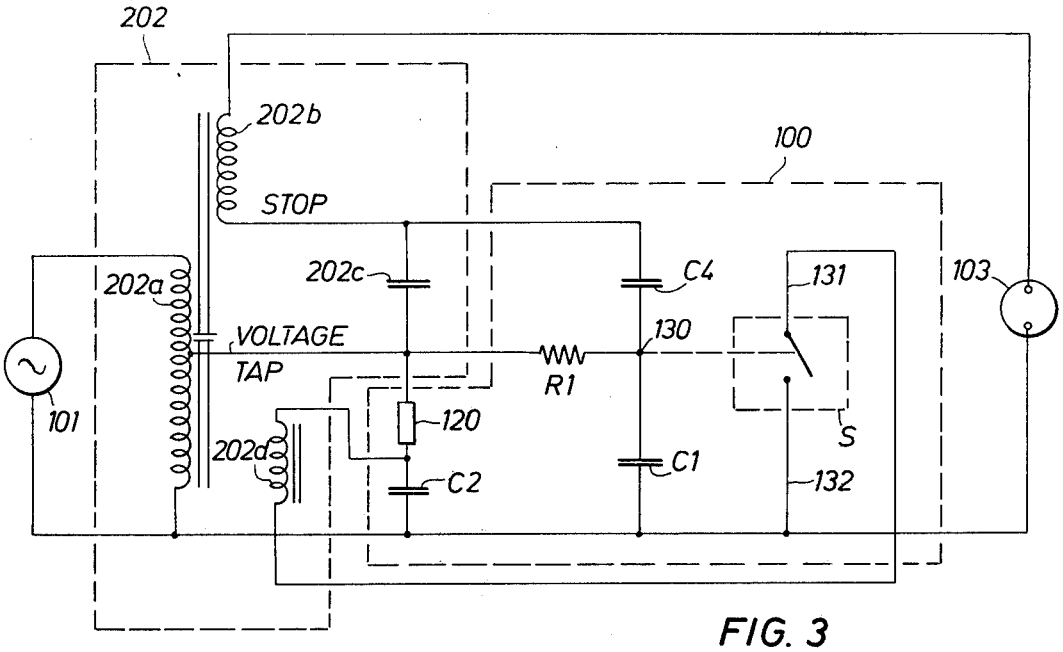
FIG. 3 is an electrical schematic diagram which illustrates the manner in which an embodiment of the starter circuit may be utilized in a gaseous-discharge lamp lighting system in which there is a ballast having an insulated starter winding and in which one terminal of the gaseous-discharge lamp is connected to the common of the ballast.

Referring now to FIG. 3, in some applications it may be desirable to connect one terminal of gaseous-discharge lamp 103 directly to the common lead of the ballast 202. In this situation, ballast capacitor 202*c* is connected between the voltage tap of primary 202*a* and the stop winding of secondary 202*b*.

Still referring to FIG. 3, the illustrated embodiment of ballast 202 includes an insulated starter winding 202*d* which is connected in series with switch S. One terminal of switch S is connected to the common lead of ballast 202, and one terminal of starter winding 202*d* is connected to the junction of resistive element 120 and pulser capacitor C2.

When the voltage across timing capacitor C1 is sufficient to close switch S, capacitor C2 discharges through starter winding 202*d* and switch S. The magnetic coupling between starter winding 202*d* and secondary 202*b* induces a high voltage between the lamp lead and the stop winding of secondary 202*b*, and this high voltage is seen by gaseous-discharge lamp 103. When gaseous-discharge lamp 103 approaches its normal operating condition, timing capacitor C1 can no longer charge to a level sufficient to close switch S, and the starting pulses are discontinued. Either of the embodiments of switch S illustrated in FIGS. 4*a* and 4*b* may be utilized in the illustrated embodiment of starter circuit 100, and resistive element 120 may comprise either a resistor 500 (FIG. 5*a*) or an incandescent lamp 501 (FIG. 5*b*), or the coil 502*a* of a relay (FIG. 5*c*). When resistive element 120 comprises incandescent lamp 501, it is preferable that the FIG. 4*b* embodiment of switch S be utilized in starting circuit 100.

Referring now to FIG. 6, the illustrated gaseous-discharge lamp lighting system comprises ballast 602, similar in construction to ballast 102 of FIG. 1. A source of AC voltage 101 is applied across the line and common leads of ballast 602, and the voltage tap of primary 602*a* is connected to the stop (or end) winding of secondary 602*b*. The serial combination of gaseous-discharge lamp 610 and ballast capacitor 602*c* is connected in parallel between the lamp and common leads of ballast 602, with one terminal of gaseous-discharge lamp 610 being connected to the lamp lead of ballast 602.

The illustrated embodiment of auxiliary lighting circuit 600 comprises timing capacitor 601, shutoff capacitor 602, timing resistor 603, switch S and resistive element 606. One terminal of timing capacitor 601 is connected to the stop winding of secondary 602*b*, and the second terminal of timing capacitor 601 is connected to the first terminals of timing resistor 603 and shutoff capacitor 604 (i.e., at point 610). The second terminal of timing resistor 603 is connected to the common lead of ballast 602, and the second terminal of shutoff capacitor 604 is connected to one terminal of gaseous-discharge lamp 103. One main terminal of switch S is connected to the stop winding of secondary 602*b* and the second main terminal of switch S is connected to one terminal of resistive element 606. The second terminal of resistive element 606 is connected to the common lead of ballast 602.

Switch S is a voltage dependent switch of the type described above, and it will be recalled that examplary embodiments of switch S are illustrated in FIGS. 4*a* and 4*b*. The following description assumes that the FIG. 4*b* embodiment of switch S is used in auxiliary lighting circuit 600.

Referring to FIGS. 5*b*, 5*c* and 6, in one embodiment of auxiliary lighting circuit 600 resistive element 606 includes incandescent lamp 591, while in another embodiment, resistive element 606 comprises coil 502*a* of relay 502. Those skilled in the art will realize that resistive element 606 may take many forms other than the illustrated forms. The following description assumes that resistive element 606 comprises incandescent lamp 501.

Still referring to FIGS. 4*b*, 5*b* and 6, the operation of the illustrated embodiment of auxiliary lighting circuit 600 is described by assuming that gaseous-discharge lamp 610 is extinguished, and that AC voltage source 101 has just been energized. On the first half cycle of AC voltage source 101, current flows from the voltage tap of primary 602*a* into the serial combination of timing capacitor 601 and timing resistor 603. This current charges timing capacitor 601 at a rate dictated by the values of the capacitance of capacitor 601 and the resistance of timing resistor 603 and by the voltage which is present at the voltage tap of primary 602*a*.

The voltage which appears across the terminals of diac 403 (FIG. 4) is essentially the voltage across timing capacitor 601. When the voltage across timing capacitor 601 exceeds the forward breakover voltage of diac 403, diac 403 switches from a non-conductive state to a conductive state. At this time, a current is delivered from the charge on timing capacitor 601 into the gate of triac 402. This gate current enables triac 402 to switch from a non-conductive state to a conductive state, and current flows from the voltage tap of primary 602*a* through the serial combination of triac 402 and incandescent lamp 501 (FIG. 5). Since the voltage across triac 402 is very low when it is in its conductive state, the voltage across incandescent lamp 501 is approximately the voltage appearing at the voltage tap of primary 602*a*.

Once triac 402 is in its conducting state, the current through it is independent of the voltage or current appearing at the gate terminal. Triac 402 will, therefore, remain in the conductive state until the current between the main terminals is reduced to a level below that which is required to sustain conduction, i.e., until the beginning of the next half cycle of AC input voltage 101. It will be observed, therefore, that incandescent lamp 501 remains energized from approximately the time that the voltage across timing capacitor 601 exceeds the forward breakover voltage of diac 403 until the beginning of the next half cycle of AC input voltage 101. The values of timing capacitor 601, timing resistor 603 and the forward breakover voltage of diac 403 dictate the number of electrical degrees of each half cycle that incandescent lamp 501 is energized for a given value of AC input voltage 101.

Still referring to FIGS. 4*b*, 5*b* and 6, it is well known that triac 402 is a bidirectional current carrying device. During the next half cycle of AC input voltage 101, timing capacitor 601 will again charge to a voltage level such that the voltage across diac 403 exceeds its forward breakover voltage. At this time, a gate current is delivered to triac 402, triac 605 becomes conductive, and incandescent lamp 501 is energized for the remainder of that half cycle of AC input voltage 101.

When gaseous-discharge lamp 610 does fire, the voltage across it will be low, and there will be a fairly high voltage across ballast capacitor 602*c* that is seen by shut-off capacitor 604. The network of timing capacitor 601, shutoff capacitor 604, and timing resistor 603 senses the changing amplitude and phase relationships between the voltage across ballast capacitor 602*c* and the voltage between the voltage tap and common as gaseous-discharge lamp 610 warms up. During the initial warmup period of lamp 610, the amplitude and phase angle of the voltage across ballast capacitor 602*c* with respect ot the voltage at the voltage tap are such that the voltage appearing across timing capacitor 601 is sufficient to render diac 403 conductive during each half cycle of AC input voltage 101. When, however, gaseous-discharge lamp 610 approaches its normal operating condition, the amplitude and phase angle of the charging current into timing capacitor 601 from timing resistor 603 and the amplitude and phase angle of the charging current into timing capacitor 601 from shutoff capacitor 604 are such that timing capacitor 601 ceases to charge to a sufficient level to render diac 403 conductive. Hence, at this time the embodiment of auxiliary lighting circuit 600 is disabled, and incandescent lamp 501 no longer lights.

Referring to FIGS. 4*b* and 6, the values and types of components comprising one embodiment of auxiliary lighting circuit 600 which is designed to operate with a 240 volt, 60 Hz input voltage 101, are as follows.

Timing capacitor 601 should preferably have a positive temperature coefficient to compensate for the negative temperature coefficient of diac 402. A capacitor having a polyester foil or mylar foil has such a positive temperature coefficient. Capacitor 601 preferably has a value of 0.1 microfarads, ± 10 percent, (100 WVDC).

Timing resistor 603 may be a standard carbon resistor having no special characteristics. The nominal value of timing resistor 603 is 100,000 ohms, ½ watt, 5 percent.

Shutoff capacitor 604 should be a low leakage capacitor with a high voltage rating and should preferably be AC rated for at least 600 volts RMS. The preferred value of capacitor 602 is 5.6 nanofarads, ± 10 percent.

Diac 403 is preferably a 1N5761A, and triac 402 is preferably a 2N6157, each of which is manufactured by Motorola, Inc.

Figure 7:
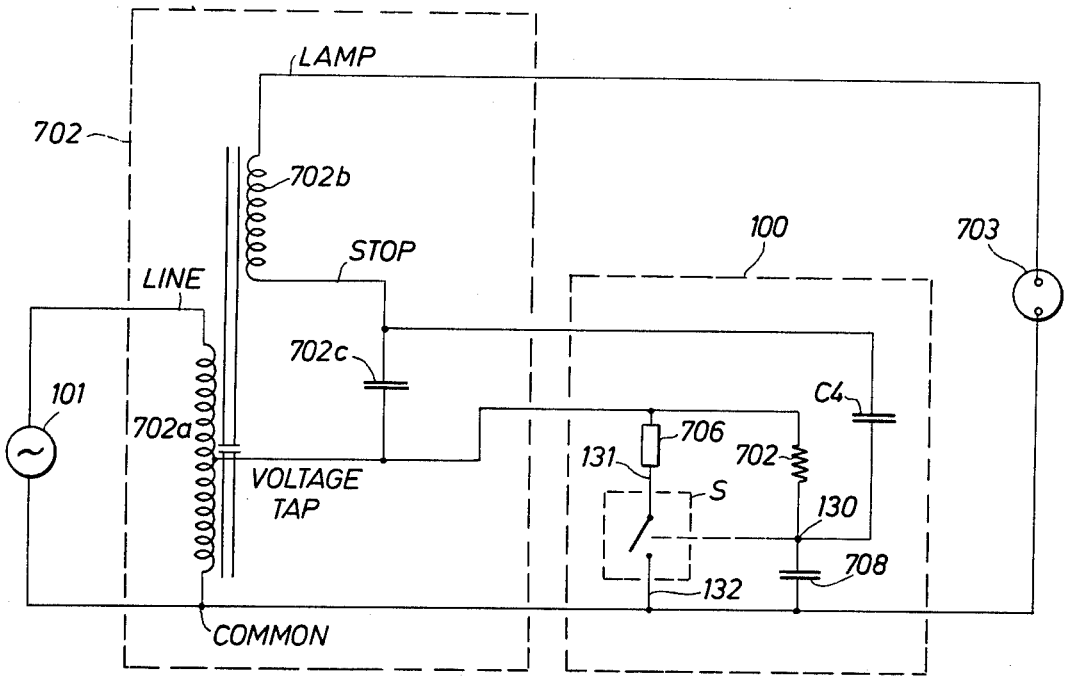
FIG. 7 is an electrical schematic diagram which illustrates the manner in which the embodiment of the auxiliary lighting circuit of FIG. 6 may be utilized with a gaseous-discharge lamp that does not require a starting pulse.

Referring now to FIG. 7, there is illustrated a gaseous-discharge lamp lighting system employing a mercury vapor or metal halide gaseous-discharge lamp 703. When either of these type lamps is utilized with a lead-peaked regulating type ballast, one terminal of gaseous-discharge lamp 703 is preferably connected to the common lead of ballast 702 and ballast capacitor 702*c* is connected between the voltage tap of primary winding 702*a* and the stop winding of secondary 702*b*. The embodiment of auxiliary lighting circuit 700 is connected as shown and functions in an essentially identical manner in this lighting system as it does in the lighting system illustrated in FIG. 6. Resistive element 706 may comprise incandescent lamp 501 (FIG. 5*b*) which is energized until gaseous-discharge lamp 703 approaches its normal operating condition. At this time, the amplitude and phase angle of the charging current into timing capacitor 708 from timing resistor 702 and the amplitude and phase angle of the charging current into timing capacitor 708 from shutoff capacitor C4 are such that timing capacitor 708 ceases to charge to a level sufficient to close switch S. Hence, incandescent lamp 501 will no longer be energized during the normal operation of gaseous-discharge lamp 703.

Referring to FIGS. 4*a*, 4*b* and 7, an embodiment of auxiliary lighting circuit 700 may comprise either configuration of switch S illustrated in FIGS. 4*a* and 4*b*. The preferred embodiment of auxiliary lighting circuit 700 comprises the configuration of switch S illustrated in FIG. 4*b*.

Figure 8:
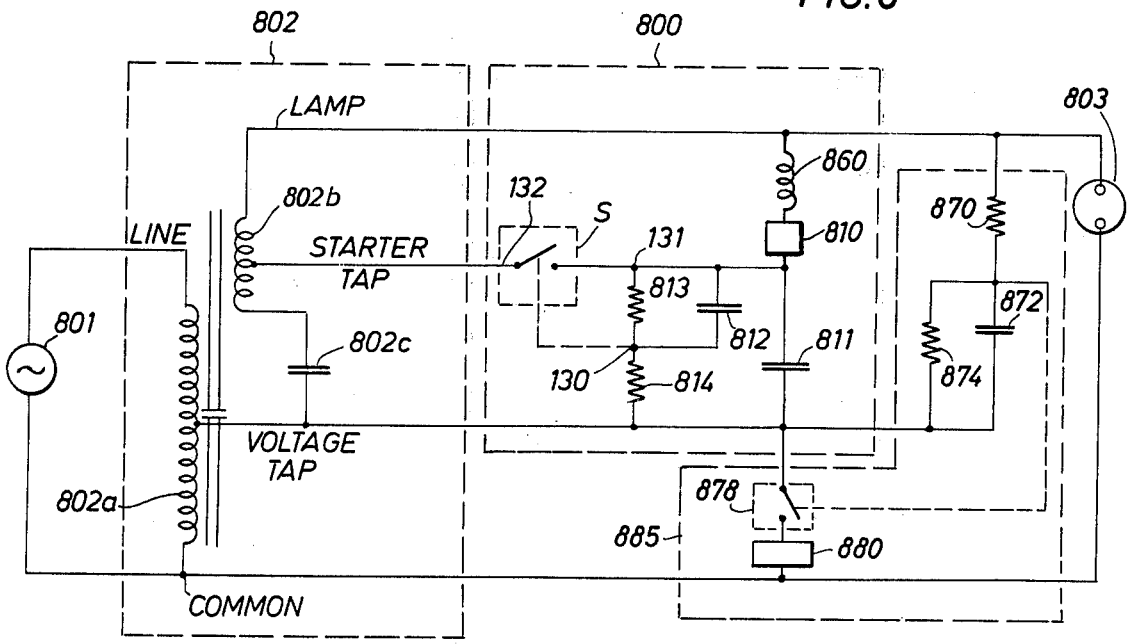
FIG. 8 is an electrical schematic diagram of one configuration of a gaseous-discharge lamp lighting system which includes an embodiment of a positive shut-off starting circuit according to the present invention.

Referring now to FIG. 8, the illustrated gaseous-discharge lamp lighting system comprises a source of AC voltage 801, ballast 802, and gaseous-discharge lamp 803. Ballast 802 is preferrably a lead-peaked regulating ballast which includes: a primary winding 802*a*, the ends of which provide the lamp and common leads of the ballast; a voltage tap which emerges from the primary winding 802*a*; a secondary winding, one end of which provides the lamp lead of the ballast; a starter tap which emerges a predetermined number of turns from the second end of secondary 802*b*; and a ballast capacitor 802*c*. Ballast capacitor 802*c*, secondary 802*b* and gaseous-discharge lamp 803 are connected in a serial arrangement between the voltage tap of primary 802*a* and the common lead of the ballast as follows. One terminal of ballast capacitor 802*c* is connected to the voltage tap of primary 802*a*, and the second terminal of ballast capacitor 802*c* is connected to the second end of secondary 802*b*. The first end (lamp lead) of secondary 802*b* is connected to one terminal of gaseous-discharge lamp 803, and the second terminal of gaseous-discharge lamp 803 is connected to the common lead of the ballast.

The illustrated embodiment of starting circuit 800 comprises resistive element 810, pulser capacitor 811, timing capacitor 812, shunt resistor 813, timing resistor 814 and switch S. One terminal of resistive element 810 is connected to the lamp lead of the ballast, and the second terminal of resistor 810 is connected to the first terminals of pulser capacitor 811, timing capacitor 812 and shunt resistor 813. The second terminals of shunt resistor 813 and timing capacitor 812 are connected to the first terminal of timing resistor 814, and the second terminals of timing resistor 814 and pulser capacitor 811 are connected to the voltage tap of primary 802*a*. The main terminals of switch S are connected between the starter tap of secondary 802*b* and the first terminal of shunt resistor 813.

Switch S is a voltage dependent switch of the type described above, and its closing is determined by the voltage across timing capacitor 812. As long as this voltage is below a certain level, switch S will remain open.

Still referring to FIG. 8, the operation of the illustrated embodiment of starter circuit 800 is described by assuming that gaseous-discharge lamp 803 is extinguished. When AC voltage source 801 is energized, gaseous-discharge lamp 803 initially draws no current. At this time, ballast 802 acts like a transformer, and the magnetic coupling between secondary winding 802*b* and primary winding 802*a* causes a voltage to be induced across secondary 802*b* due to the present of the voltage across primary 802*a*.

The voltage across secondary winding 802*b* has a current conduction path comprising resistive element 810, pulser capacitor 811, and ballast capacitor 802*c*. The value of ballast capacitor 802*c* is chosen such that it presents a low impedance to the open circuit voltage of the secondary winding 802*b*, and, therefore, pulser capacitor 811 begins to charge at a rate dictated approximately by the values of pulser capacitor 811 and the resistance value of resistive element 810 and the waveform of the open circuit voltage of ballast 802.

As the voltage across pulser capacitor 811 increases, pulser capacitor 811 becomes a voltage source for the resistive-capacitive network comprising timing capacitor 812, shunt resistor 813 and timing resistor 814. Current flows, therefore, from pulser capacitor 811 to charge timing capacitor 812 at a rate dictated approximately by the values of timing capacitor 812, timing resistor 814, and shunt resistor 813 and the voltage across pulser capacitor 811.

When the voltage across timing capacitor 812 exceeds a certain level, switch S is closed and pulser capacitor 811 is discharged in the loop comprising the starter winding of ballast 802 and ballast capacitor 802*c*. Since ballast capacitor 802*c* presents a low impedance, a maximum current flows into the starter windings of ballast 802. At this time a very high voltage will be developed between the lamp lead and the stop winding of secondary 802*b* due to the transformation action of secondary 802*b*. This voltage plus the voltage between the voltage tap of primary 802*a* and the common lead of ballast 802 is seen by gaseous-discharge lamp 803.

A plurality of starting pulses may have to be applied to gaseous-discharge lamp 803 before it ignites and begins to conduct current. When gaseous-discharge lamp 803 does ignite, the voltage across it will drop to a very low value and then increase to its normal operating voltage. This normal operating voltage will, of course, be less than the peak open circuit voltage of ballast 802 before gaseous-discharge lamp 803 ignited. Hence, after gaseous-discharge lamp 803 ignites, the voltage across pulser capacitor 811 will not, while lamp 803 is operating, be as great as it was before gaseous-discharge lamp 803 ignited. Consequently, the voltage developed across timing capacitor 812 will always be less than the level it reached prior to gaseous-discharge lamp 803 firing. The threshold voltage at which switch S closes is chosen such that switch S is operative before ignition, but inoperative after ignition of lamp 803. Hence, a starting circuit having a positive shutoff feature is realized.

Referring now to FIGS. 4*a* and 4*b*, there are illustrated two embodiments of switch S which may be utilized in the illustrated embodiment of starting circuit 800 (FIG. 8.). The operation of each of these embodiments has been previously discussed with respect to these circuits illustrated in FIGS. 1–3 and will not be repeated. FIG. 4*b* is a preferred embodiment of switch S, since starting pulses will be generated each half cycle of the input AC voltage 801.

Even though the voltage developed across pulser capacitor 811 is insufficient to trigger switch S at the normal operating voltage of gaseous-discharge lamp 803, the voltage across the main terminals of switch S will be very high during the normal operation of gaseous-discharge lamp 803. Consequently, an embodiment of switch S must utilize components which can withstand this very high voltage without entering a conduction state.

Figure 9:
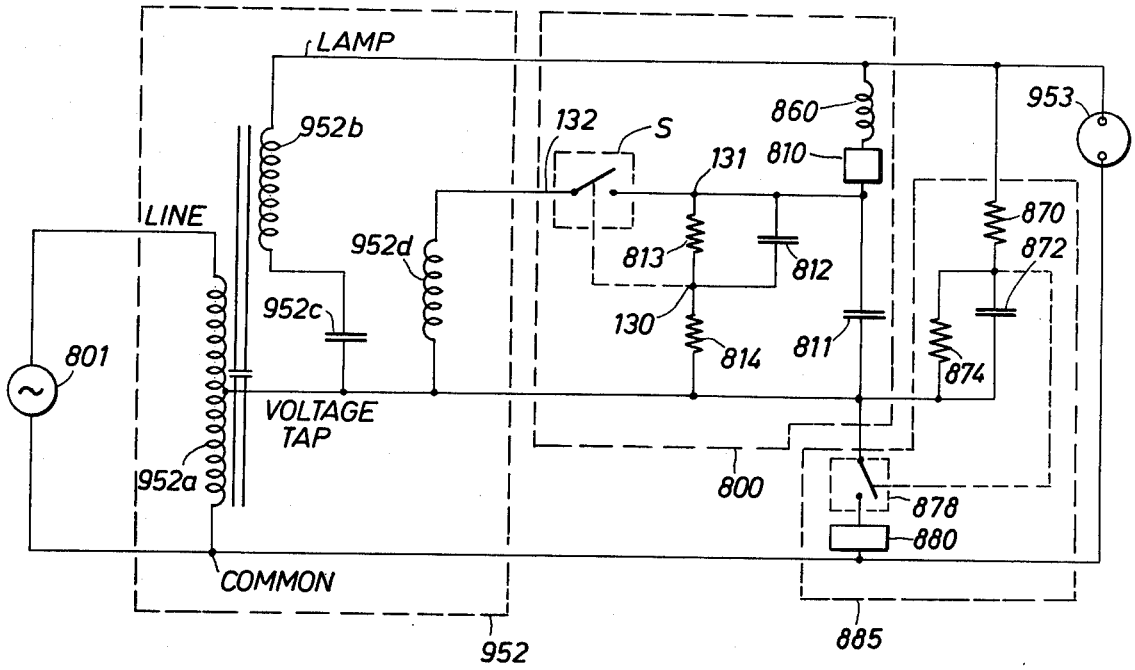
FIG. 9 is an electrical schematic diagram of another configuration of a gaseous-discharge system which includes the embodiment of the positive shut-off circuit of FIG. 8.

Referring now to FIG. 9, there is illustrated yet another gaseous-discharge lamp lighting system which comprises a source of AC voltage 801, ballast 952, and gaseous-discharge lamp 953. Ballast 952 is similar to ballast 802 (FIG. 8), but includes an insulated starter winding 952*d*, whereas the starter winding of ballast 802 was integral with the secondary winding of ballast 802. The connection of the AC input voltage 801, ballast 952, and gaseous-discharge lamp 953 is identical to the connection of similar components of the system illustrated in FIG. 8.

It will be observed that the embodiment of starter circuit 800 which was illustrated and described with reference to FIG. 8 may also be utilized in the gaseous-discharge lamp lighting system illustrated in FIG. 9, and the operation of starting circuit 800 is similar in each system. When switch S is closed in the system illustrated in FIG. 9, pulser capacitor 811 discharges through insulated starter winding 952*d*. The current flowing in insulated starter winding 952*d* induces a voltage across secondary winding 952*b*, and this voltage plus the voltage between the voltage tap and the common of the ballast is applied to gaseous-discharge lamp 953. When gaseous-discharge lamp 953 ignites, starting circuit 800 again ceases to generate additional starting pulses.

There is one significant difference between the ratings of the components utilized in switch S in the FIG. 9 lighting system and the rating of the components of switch S utilized in the FIG. 8 lighting system. During normal operation of gaseous-discharge lamp 953 (FIG. 9) the voltage appearing between the main terminals of switch S is much lower than the voltage appearing between the terminals of switch S in the system of FIG. 8. Consequently, components having lower voltage ratings may be chosen to implement switch S in the system illustrated in FIG. 9.

Figure 10:
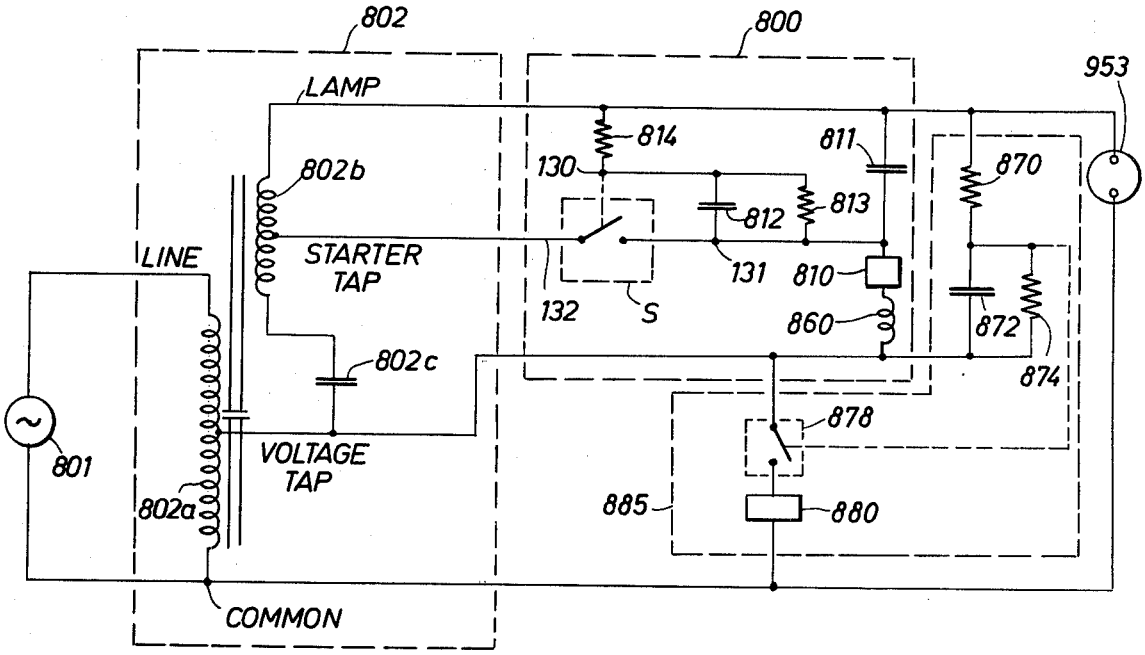
FIG. 10 is an electrical schematic diagram which illustrates yet another configuration of a gaseous-discharge lighting system which includes the embodiment of the starting circuit of FIG. 8.

Referring now to FIG. 10, there is illustrated yet another gaseous-discharge lamp lighting system which utilizes an embodiment of starter circuit 800, and starter circuit 800 functions in this system in a manner similar to its functioning in the systems illustrated in FIGS. 8 and 9. It will be observed that the system illustrated in FIG. 10 is similar to the system illustrated in FIG. 8 except that the starter tap of ballast 802 is located closer to the end of secondary winding 802*b* which provides the lamp lead of the ballast.

Referring to FIGS. 8, 9, 10, and 5*b*–5*c* the embodiment of starting circuit 800 may additionally function as a source of auxiliary lighting when, for example, resistive element 810 is an incandescent lamp 501 (FIG. 5). When switch S is closed, the voltage between the lamp lead and the voltage tap energizes incandescent lamp 501, thereby providing an auxiliary source of illumination. Since each starting pulse generated by starting circuit 800 has a high frequency, it is preferable to include a reactance 860, which presents a high impedence to a high frequency signal, in series with incandescent lamp 501.

In the system illustrated in FIG. 8, reactance 860 is preferably an inductor, and when switch S is closed, a substantial portion of the voltage of the starting pulse presented to gaseous-discharge lamp 803 appears across of this inductor. Consequently, the voltage appearing across incandescent lamp 501 is substantially the voltage between the lamp lead and the voltage tap of ballast 802.

Resistive element 810 may also comprise coil 502*a* of relay 502 (FIG. 5*c*) to enable the embodiment of starting circuit 800 illustrated in FIGS. 8, 9, and 10 to provide auxiliary lighting. When resistive element 810 comprises coil 502*a*, the inclusion of reactance 860 in series with coil 502*a* is not necessary.

Referring to FIG. 8, it has been found to be preferable to utilize separate circuitry to activate a source of auxiliary light in a system which utilizes this starting circuit. This separate circuitry operates independently of the starting circuit, and consequently, the times at which auxiliary lighting is available may be more precisely controlled.

As shown, auxiliary lighting circuit 885 comprises resistors 870 and 874, capacitor 872, switch 878 and resistive element 880. Resistor 870 and capacitor 872 are connected in a serial arrangement between the lamp lead and the voltage tap of ballast 802; resistor 874 is connected in parallel with capacitor 872; one terminal of switch 878 is connected to the voltage tap of ballast 802, the second terminal of switch 878 is connected to one terminal of resistive element 880; and the second terminal of resistive element 880 is connected to the common lead of ballast 802.

Switch 878 is a voltage dependent switch and may, for example, take either of the embodiments of switch S shown in FIGS. 4*a* and 4*b*. The voltage across capacitor 872 determines the closing of switch 878, and the closure of switch 878 enables resistive element 880 to be energized by the voltage appearing between the voltage tap and common lead of ballast 802.

In operation, capacitor 872 begins to charge via resistor 870 by the voltage which is induced across the secondary 802*b* of ballast 802. When the voltage across capacitor 872 exceeds the threshold level of switch 878, switch 878 closes, thereby allowing resistive element 880 to be energized.

When gaseous-discharge lamp 803 ignites, the voltage appearing between the lamp lead and voltage tap of ballast 802 is at such a level that capacitor 872 can no longer charge to a level sufficient to close switch 878. Hence, at this time, resistive element 880 ceases to be energized, and no auxiliary light will be provided during the warm-up of gaseous-discharge lamp 803 or during its normal operating condition. When, however, gaseous-discharge lamp 803 is extinguished, due either to failure or momentary power interruption, auxiliary lighting circuit 885 again becomes operational to provide auxiliary lighting until gaseous-discharge lamp 803 restrikes.

Referring to FIGS. 8 and 5*b*–5*c*, resistive element 880 may comprise an incandescent lamp 501 or the coil 502*a* of relay 502.

Referring to FIGS. 9 and 10, there is illustrated the manner in which auxiliary lighting circuit 885 may be utilized in these configurations of gaseous-discharge lamp lighting systems. The operation of auxiliary lighting circuit 885 in these configurations is similar to its operation in the system described above with respect to FIG. 8.

What is claimed is:

1. In a gaseous-discharge lamp lighting system including a ballast having line and common leads for receiving an AC input voltage, a lamp lead, and a starter winding, and a gaseous-discharge lamp which is operatively connected between the lamp and common leads of the ballast, the improvement comprising:

A starter circuit for generating starting pulses to the gaseous-discharge lamp, which starter circuit comprises:

(a) a first resistive element and a first capacitor operatively connected to form a first series combination, said first series combination operatively connected to the ballast;

(b) a second capacitor and a second resistive element operatively connected to form a second series combination, said second series combination operatively connected to the ballast;

(c) a switch operatively connected in series with the starter winding, said switch and starter winding operatively connected in parallel with the second capacitor, the closing of the switch being determined by the voltage across the first capacitor and the closure of the switch enabling the second capacitor to discharge through the starter winding; and (d) a sensing circuit, including a reactance, which is operatively connected between the gaseous-discharge lamp and the junction between the first resistive element and first capacitor for preventing closures of the switch when the gaseous-discharge lamp approaches its normal operating condition.

2. The starting circuit of claim 1, wherein the second resistive element comprises a resistor.

3. The starting circuit of claim 1, wherein the second resistive element comprises an incandescent lamp.

4. The starting circuit of claim 1, wherein the second resistive element comprises the coil of a relay.

5. The starting circuit of claim 1, wherein the switch comprises an SCR and a diac.

6. The starting circuit of claim 5, wherein the second resistive element comprises a resistor.

7. The starting circuit of claim 5, wherein the second resistive element comprises an incandescent lamp.

8. The starting circuit of claim 5, wherein the second resistive element comprises the coil of a relay.

9. The starting circuit of claim 1, wherein the switch comprises a triac and a diac.

10. The starting circuit of claim 9, wherein the second resistive element comprises a resistor.

11. The starting circuit of claim 9, wherein the second resistive element comprises an incandescent lamp.

12. The starting circuit of claim 9, wherein the second resistive element comprises the coil of a relay.

13. In a gaseous-discharge lamp lighting system including a lead-peaked regulating type ballast having a primary winding providing the line and common leads for receiving an AC input voltage, having a voltage tap, having a secondary winding with the first end thereof providing the lamp lead of the ballast, having a starter winding, and having a ballast capacitor, and a gaseous-discharge lamp, the gaseous-discharge lamp, ballast capacitor, and secondary winding of the ballast operatively connected in a serial arrangement between the voltage tap of the primary and the common lead of the ballast, A starter circuit for generating starting pulses to the gaseous-discharge lamp, which starter circuit comprises:

(a) a first resistive element and a first capacitor operatively connected in series between the voltage tap and the common lead of the ballast;

(b) a second capacitor and a second resistive element operatively connected in series between the voltage tap and the common lead of the ballast;

(c) a switch which is operatively connected in series with the starter winding, said switch and starter winding operatively connected in parallel with the second capacitor, the closing of the switch being determined by the voltage across the first capacitor and the closure of the switch enabling the second capacitor to discharge through the starter winding; and (d) a sensing circuit, including a reactance, operatively connected between one terminal of the ballast capacitor and the junction between the first resistive element and first capacitor for preventing closures of the switch when the gaseous-discharge lamp approaches its normal operating condition.

14. The starting circuit of claim 13, wherein the second resistive element comprises a resistor.

15. The starting circuit of claim 13, wherein the second resistive element comprises an incandescent lamp.

16. The starting circuit of claim 13, wherein the second resistive element comprises the coil of a relay.

17. The starting circuit of claim 13, wherein the switch comprises an SCR and a diac.

18. The starting circuit of claim 17, wherein the second resistive element comprises a resistor.

19. The starting circuit of claim 17, wherein the second resistive element comprises an incandescent lamp.

20. The starting circuit of claim 17, wherein the second resistive element comprises the coil of a relay.

21. The starting circuit of claim 13, wherein the switch comprises a triac and a diac.

22. The starting circuit of claim 21, wherein the second resistive element comprises a resistor.

23. The starting circuit of claim 21, wherein the second resistive element comprises an incandescent lamp.

24. The starting circuit of claim 21, wherein the second resistive element comprises the coil of a relay.

25. A starter circuit for use in a gaseous-discharge lamp lighting system, said system including a ballast having line and common leads for receiving an AC input voltage, a starter winding and a lamp lead, and a gaseous-discharge lamp which is operatively connected between the lamp and common leads of the ballast, said starter circuit comprising:

(a) a first resistive element and a first capacitor operatively connected to form a first series combination, said first series combination adapted for operative connection to the ballast;

(b) a second capacitor and a second resistive element operatively connected to form a second series combination, said second series combination adapted for operative connection to the ballast such that, in operation, the second capacitor is charged;

(c) a switch operatively connected in series with the starter winding, said switch and starter winding operatively connected in parallel with the second capacitor, such that, in operation, the closing of the switch is determined by the voltage across the first capacitor and the closure of the switch enables the second capacitor to discharge through the starter winding; and (d) a sensing circuit, including a reactance, which is adapted for operative connection between the gaseous-discharge lamp and the junction between the first resistive element and first capacitor, such that, in operation, closures of switch are prevented when the gaseous-discharge lamp approaches its normal operating condition.

26. The starting circuit of claim 25, wherein the second resistive element comprises a resistor.

27. The starting circuit of claim 25, wherein the second resistive element comprises an incandescent lamp.

28. The starting circuit of claim 25, wherein the second resistive element comprises the coil of a relay.

29. The starting circuit of claim 25, wherein the switch comprises an SCR and a diac.

30. The starting circuit of claim 29, wherein the second resistive element comprises a resistor.

31. The starting circuit of claim 29, wherein the second resistive element comprises an incandescent lamp.

32. The starting circuit of claim 29, wherein the second resistive element comprises the coil of a relay.

33. The starting circuit of claim 25, wherein the switch comprises a triac and a diac.

34. The starting circuit of claim 33, wherein the second resistive element comprises a resistor.

35. The starting circuit of claim 33, wherein the second resistive element comprises an incandescent lamp.

36. The starting circuit of claim 33, wherein the second resistive element comprises the coil of a relay.

37. A starter circuit for use in a gaseous-discharge lamp lighting system, said system including a lead-peaked regulating type ballast having a primary winding with line and common leads for receiving an AC input voltage, having a voltage tap, having a starter winding, and having a secondary winding with one end thereof providing the lamp lead of the ballast, and having a ballast capacitor, and a gaseous-discharge lamp which is operatively connected in series with the ballast capacitor and the secondary winding between the voltage tap and common lead of the ballast, said starter circuit comprising:

(a) a first resistive element and a first capacitor adapted for operative connection in series between the voltage tap of the primary and the common lead of the ballast;

(b) a second capacitor and a second resistive element adapted for operative connection in series between the voltage tap and the common lead of the ballast, such that, in operation, the second capacitor is charged;

(c) a switch in series with the starter winding, said switch and starter winding adpated for operative connection in parallel with the second capacitor, such that, in operation, the closing of the switch enables the second capacitor to discharge through the starter winding; and (d) a sensing circuit, including a reactance, adapted for operative connection between one terminal of the ballast capacitor and the junction between the first resistive element and first capacitor such that, in operation, closures of the switch are prevented when the gaseous-discharge lamp approaches its operating condition.

38. The starting circuit of claim 37, wherein the second resistive element comprises a resistor.

39. The starting circuit of claim 37, wherein the second resistive element comprises an incandescent lamp.

40. The starting circuit of claim 37, wherein the second resistive element comprises the coil of a relay.

41. The starting circuit of claim 37, wherein the switch comprises an SCR and a diac.

42. The starting circuit of claim 41, wherein the second resistive element comprises a resistor.

43. The starting circuit of claim 41, wherein the second resistive element comprises an incandescent lamp.

44. The starting circuit of claim 41, wherein the second resistive element comprises the coil of a relay.

45. The starting circuit of claim 37, wherein the switch comprises a triac and a diac.

46. The starting circuit of claim 45, wherein the second resistive element comprises a resistor.

47. The starting circuit of claim 45, wherein the second resistive element comprises an incandescent lamp.

48. The starting circuit of claim 45, wherein the second resistive element comprises the coil of a relay.

49. In a gaseous-discharge lamp lighting system, said system including a lead-peaked regulating type ballast having a primary winding with line and common leads for receiving an AC input voltage, having a voltage tap, having a secondary winding with one end thereof providing the lamp lead of the ballast, and having a ballast capacitor, and a gaseous-discharge lamp which is operatively connected in series with the ballast capacitor and secondary winding between the voltage tap and the common lead of the ballast, the improvement comprising an auxiliary lighting circuit which includes:

(a) a first resistive element and a capacitor operatively connected in series between the voltage tap and common lead of the ballast;

(b) a second resistive element and a switch operatively connected in series between the voltage tap and the common of the ballast, the closing of the switch being determined by the voltage across the first capacitor and the closure of the switch allowing the second resistive element to be energized; and (c) a sensing circuit, including a reactance; operatively connected between one terminal of the ballast capacitor and the junction of the first resistive element and the first capacitor for preventing closures of the switch when the gaseous-discharge lamp approaches its normal operating condition.

50. The auxiliary lighting circuit of claim 49, wherein the second resistive element comprises an incandescent lamp.

51. The auxiliary lighting circuit of claim 49, wherein the second resistive element comprises the coil of a relay.

52. The auxiliary light circuit of claim 49, wherein the switch comprises an SCR and a diac.

53. The auxiliary lighting circuit of claim 52, wherein the second resistive element comprises an incandescent lamp.

54. The auxiliary lighting circuit of claim 52, wherein the second resistive element comprises the coil of a relay.

55. The auxiliary lighting circuit of claim 49, wherein the switch comprises a triac and a diac.

56. The auxiliary lighting circuit of claim 55, wherein the second resistive element comprises an incandescent lamp.

57. The auxiliary lighting circuit of claim 55, wherein the second resistive element comprises the coil of a relay.

58. An auxiliary lighting circuit for use in a gaseous-discharge lamp lighting system, said system including a lead-peaked regulating type ballast having a primary winding with line and common leads for receiving an AC input voltage, having a voltage tap, having secondary winding one end thereof providing the lamp lead of the ballast, and having a ballast capacitor, and a gaseous-discharge lamp which is operatively connected in series with the ballast capacitor and secondary winding between the voltage tap and the common lead of the ballast, said auxiliary lighting circuit comprising:

(a) a first resistive element and a first capacitor adapted for operative connection in series between the voltage tap and common lead of the ballast;

(b) a second resistive element and a switch adapted for operative connection in series between the voltage tap and the common of the ballast such that, in operation, the closing of the switch is determined by the voltage across the first capacitor and the closure of the switch allows the second resistive element to be energized; and (c) a sensing circuit, including a reactance, adapted for operative connection between one terminal of the ballast capacitor and the junction of the first resistive element and the first capacitor, such that, in operation, closures of the switch are prevented when the gaseous-discharge lamp approaches its normal operating condition.

59. The auxiliary lighting circuit of claim 58, wherein the second resistive element comprises an incandescent lamp.

60. The auxiliary lighting circuit of claim 58, wherein the second resistive element comprises the coil of a relay.

61. The auxiliary light circuit of claim 58, wherein the switch comprises an SCR and a diac.

62. The auxiliary lighting circuit of claim 61, wherein the second resistive element comprises an incandescent lamp.

63. The auxiliary lighting circuit of claim 61, wherein the second resistive element comprises the coil of a relay.

64. The auxiliary lighting circuit of claim 58, wherein the switch comprises a triac and a diac.

65. The auxiliary lighting circuit of claim 64, wherein the second resistive element comprises an incandescent lamp.

66. The auxiliary lighting circuit of claim 64, wherein the second resistive element comprises the coil of a relay.

67. In a gaseous-discharge lamp lighting system, including a ballast having line and common leads for receiving an AC input voltage, a lamp and a starter winding, and a gaseous-discharge lamp operatively connected between the lamp and common leads of the ballast, the improvement comprising:

A starter circuit for generating starting pulses to the gaseous-discharge lamp which terminates the generation of starting pulses once the gaseous-discharge lamp ignites, said starter circuit comprising:

(a) a first capacitor and a first resistive element operatively connected in series, said series connection operatively connected to the ballast;

(b) a second capacitor and a second resistor element operatively connected in series across the first capacitor; and (c) a switch operatively connected between the first capacitor and one end of the starter winding, the closing of the switch being determined by the voltage across the second capacitor and the closure of the switch enabling the first capacitor to discharge through the starter winding.

68. The starting circuit of claim 67, wherein the first resistive element comprises a resistor.

69. The starting circuit of claim 67, wherein the first resistive element comprises an incandescent lamp.

70. The starting circuit of claim 67, wherein the first resistive element comprises the coil of a relay.

71. The starting circuit of claim 67, wherein the switch comprises an SCR and a diac.

72. The starting circuit of claim 71, wherein the first resistive element comprises a resistor.

73. The starting circuit of claim 71, wherein the first resistive element comprises an incandescent lamp.

74. The starting circuit of claim 71, wherein the first resistive element comprises the coil of a relay.

75. The starting circuit of claim 67, wherein the switch comprises a triac and a diac.

76. The starting circuit of claim 75, wherein the first resistive element comprises a resistor.

77. The starting circuit of claim 75, wherein the first resistive element comprises an incandescent lamp.

78. The starting circuit of claim 75, wherein the first resistive element comprises the coil of a relay.

79. In a gaseous-discharge lamp lighting system, including a lead-peaked regulating type ballast having a primary winding providing line and common leads for receiving an AC input voltage, having a voltage tap, having a secondary with one end thereof providing the lamp lead of the ballast, and having a starter winding, and a gaseous-discharge lamp, which is operatively connected in a serial arrangement with the secondary winding between the voltage tap and the common of the ballast, A starter circuit for generating starting pulses to the gaseous-discharge lamp which terminates the generation of starting pulses once the gaseous-discharge lamp ignites, comprising:

(a) a first capacitor and a first resistive element operatively connected in series between the lamp lead and voltage tap of the ballast;

(b) a second capacitor and a second resistive element operatively connected in series across the first capacitor; and (c) a switch operatively connected between the first capacitor and one end of the starter winding, the closing of the switch being determined by the voltage across the second capacitor and the closure of the switch enabling the first capacitor to discharge through the starter winding.

80. The starting circuit of claim 79, wherein the first resistive element comprises a resistor.

81. The starting circuit of claim 79, wherein the first resistive element comprises an incandescent lamp.

82. The starting circuit of claim 79, wherein the first resistive element comprises the coil of a relay.

83. The starting circuit of claim 79, wherein the switch comprises an SCR and a diac.

84. The starting circuit of claim 83, wherein the first resistive element comprises a resistor.

85. The starting circuit of claim 83, wherein the first resistive element comprises an incandescent lamp.

86. The starting circuit of claim 83, wherein the first resistive element comprises the coil of a relay.

87. The starting circuit of claim 79, wherein the switch comprises a triac and a diac.

88. The starting circuit of claim 87, wherein the first resistive element comprises a resistor.

89. The starting circuit of claim 87, wherein the first resistive element comprises an incandescent lamp.

90. The starting circuit of claim 87, wherein the first resistive element comprises the coil of a relay.

91. A starter circuit for use in a gaseous-discharge lamp lighting system, said system including a ballast having line and common leads for receiving an AC input voltage, a lamp lead, and a starter winding, and a gaseous-discharge lamp which is operatively connected between the lamp and common leads of the ballast, which starter circuit, in operation, generates starting pulses to the gaseous-discharge lamp until the gaseous-discharge lamp ignites, comprising:

(a) a first capacitor and a first resistive element operatively connected to form a first series combination, said first series combination adapted for operative connection to the ballast;

(b) a second capacitor and a second resistive element operatively connected in series across the first capacitor; and (c) a switch operatively connected between the first capacitor and one end of the starter winding, such that, in operation, the closing of switch is determined by the voltage across the second capacitor and the closure of the switch enables the first capacitor to discharge through the starter winding.

92. The starting circuit of claim 91, wherein the first resistive element comprises a resistor.

93. The starting circuit of claim 91, wherein the first resistive element comprises an incandescent lamp.

94. The starting circuit of claim 91, wherein the first resistive element comprises the coil of a relay.

95. The starting circuit of claim 91, wherein the switch comprises an SCR and a diac.

96. The starting circuit of claim 95, wherein the first resistive element comprises a resistor.

97. The starting circuit of claim 95, wherein the first resistive element comprises an incandescent lamp.

98. The starting circuit of claim 95, wherein the first resistive element comprises the coil of a relay.

99. The starting circuit of claim 91, wherein the switch comprises a triac and a diac.

100. The starting circuit of claim 99, wherein the first resistive element comprises a resistor.

101. The starting circuit of claim 99, wherein the first resistive element comprises an incandescent lamp.

102. The starting circuit of claim 99, wherein the first resistive element comprises the coil of a relay.

103. A starter circuit for use in a gaseous-discharge lamp lighting system, said system including a lead-peaked regulating type ballast having a primary winding with line and common leads for receiving an AC input voltage, having a voltage tap on the primary, having a secondary winding with one end thereof providing the lamp lead of the ballast, and having a starter winding, and a gaseous-discharge lamp, which is operatively connected in a serial arrangement with the secondary winding between the voltage tap and common of the ballast, which starter circuit, in operation, generates starting pulses to the gaseous-discharge lamp until the gaseous-discharge lamp ignites, comprising:

(a) a first capacitor and a first resistive element adapted for operative connection in series between the lamp lead and voltage tap of the ballast;

(b) a second capacitor and a second resistive element operatively connected in series across the first capacitor; and (c) a switch operatively connected between the first capacitor and one end of the starter winding, such that, in operation, the closing of the switch is determined by the voltage across the second capacitor and the closure of the switch enables the first capacitor to discharge through the starter winding.

104. The starting circuit of claim 103, wherein the first resistive element comprises a resistor.

105. The starting circuit of claim 103, wherein the first resistive element comprises an incandescent lamp.

106. The starting circuit of claim 103, wherein the first resistive element comprises the coil of a relay.

107. The starting circuit of claim 103, wherein the switch comprises an SCR and a diac.

108. The starting circuit of claim 107, wherein the first resistive element comprises a resistor.

109. The starting circuit of claim 107, wherein the first resistive element comprises an incandescent lamp.

110. The starting circuit of claim 107, wherein the first resistive element comprises the coil of a relay.

111. The starting circuit of claim 103, wherein the switch comprises a triac and a diac.

112. The starting circuit of claim 111, wherein the first resistive element comprises a resistor.

113. The starting circuit of claim 111, wherein the first resistive element comprises an incandescent lamp.

114. The starting circuit of claim 111, wherein the first resistive element comprises the coil of a relay.

115. In a gaseous-discharge lamp lighting system said system including a ballast having line and common leads for receiving an AC input voltage, a voltage tap and a lamp lead, and having a non-sinusoidal open circuit voltage, and a gaseous-discharge lamp which is operatively connected between the lamp and common leads of the ballast, the improvement comprising an auxiliary lighting circuit which includes:

(a) a first resistive element and a first capacitor operatively connected in series to sense the voltage between the lamp lead and voltage tap of the ballast; and (b) a second resistive element and a switch operatively connected in series between the voltage tap and the common of the ballast, the closing of the switch being determined by the voltage across the first capacitor and the closure of the switch allowing the second resistive element to be energized.

116. The auxiliary lighting circuit of claim 115, wherein the second resistive element comprises an incandescent lamp.

117. The auxiliary lighting circuit of claim 115, wherein the second resistive element comprises the coil of a relay.

118. The auxiliary light circuit of claim 115, wherein the switch comprises an SCR and a diac.

119. The auxiliary lighting circuit of claim 118, wherein the second resistive element comprises an incandescent lamp.

120. The auxiliary lighting circuit of claim 118, wherein the second resistive element comprises the coil of a relay.

121. The auxiliary lighting circuit of claim 115, wherein the switch comprises a triac and a diac.

122. The auxiliary lighting circuit of claim 121, wherein the second resistive element comprises an incandescent lamp.

123. The auxiliary lighting circuit of claim 121, wherein the second resistive element comprises the coil of a relay.

* * * * *